US005538206A

United States Patent [19]

Sather

[11] Patent Number: 5,538,206

[45] Date of Patent: Jul. 23, 1996

[54] SINK SUPPORT

[76] Inventor: Steven B. Sather, 16632 Goldenwest, Apt. 4, Huntington Beach, Calif. 92647

[21] Appl. No.: 219,899

[22] Filed: Mar. 30, 1994

[51] Int. Cl.[6] ..... G12B 9/00

[52] U.S. Cl. ..... 248/27.1; 248/201; 4/643

[58] Field of Search ..... 248/27.1, 201, 248/343, 342, 298, 906, 172, 214, 274; 4/643, 647, 648, 632

[56] References Cited

U.S. PATENT DOCUMENTS

| | | | |
|---|---|---|---|
| 1,740,553 | 12/1929 | Schmiedeknecht | 4/648 |
| 2,429,455 | 10/1947 | Dellon | 4/648 |
| 2,809,002 | 10/1957 | Rudolph | 248/298 |
| 3,425,655 | 2/1969 | Cogdill | 248/343 |
| 4,088,290 | 5/1978 | Novello | 248/274 |
| 4,122,762 | 10/1978 | Williams | 248/343 |
| 4,542,831 | 9/1985 | Dazza | 4/643 |
| 5,386,959 | 2/1995 | Laughlin et al. | 248/906 |

*Primary Examiner*—Karen J. Chotkowski
*Assistant Examiner*—Anita M. King
*Attorney, Agent, or Firm*—Dennis W. Beech

[57] ABSTRACT

The sink support is a simple structural device for mounting under counter tops used in bathrooms, kitchens and other facilities to support a sink. The sink support consists of a cross member with a mounting bracket at each end. The brackets are designed to rest on the top edge of the vertical element supporting the counter top. This is typically the cabinet structure under the counter top. With two brackets so mounted, the sink may rest on the sink supports on the sink edges when the sink is placed relative to the cutout formed in the typical counter top. Adjustment screws are provided in the cross member to provide for aligning the sink with the counter top.

4 Claims, 2 Drawing Sheets

SINK SUPPORT

BACKGROUND OF THE INVENTION

1. Field of the Invention

This invention relates to devices used to support sinks in counters used in kitchens, bathrooms and other facilities. The new device provides a simple means to support a sink relative to a counter surface and provides for position adjustment.

2. Description of Related Art

There are currently in use various methods for supporting undermount sinks. A common system used is wood framing under the counter in the area where the sink is to be mounted. This is generally done by cutting wood members to fit the installation. No special technique is required other than to provide wood cross piece support under the sink by attaching the wood to the cabinet using nails, screws or glue.

Other methods in common use include insetting the sink in a sheet of plywood that has been attached securely to the cabinet. Also a metal sink frame is currently in use which is manufactured to fit a particular hole size in the counter top. The metal frame is normally in the shape of a rectangular ring. The metal frame has a top which rests on the counter and provision for the sink to be held by sink lugs attached to the frame. This approach is commonly used with formica tops which flush mount the sink. These methods are not desirable if the counter top is made of material other than wood.

The present invention provides a simple yet sturdy solution to supporting the sink with an adjustable means of leveling. The sink support provides for the mounting of simple cross piece supports under the counter top to support the weight of the sink. The supports are designed to attach to cabinet rails, face frames or other vertical cabinet supports without the need for cutting or fitting. Once installed the supports have adjustment screws to place the sink at the correct height relative to the counter top.

SUMMARY OF THE INVENTION

A primary objective of the present invention is to provide a means for a permanent, easy installation sink support relative to a solid surface material. Another object is to allow for adjustment or leveling of the sink for installation.

In accordance with the description presented herein, other objects of this invention will become apparent when the description and drawings are reviewed.

DESCRIPTION OF THE PREFERRED EMBODIMENT

Figure 1:
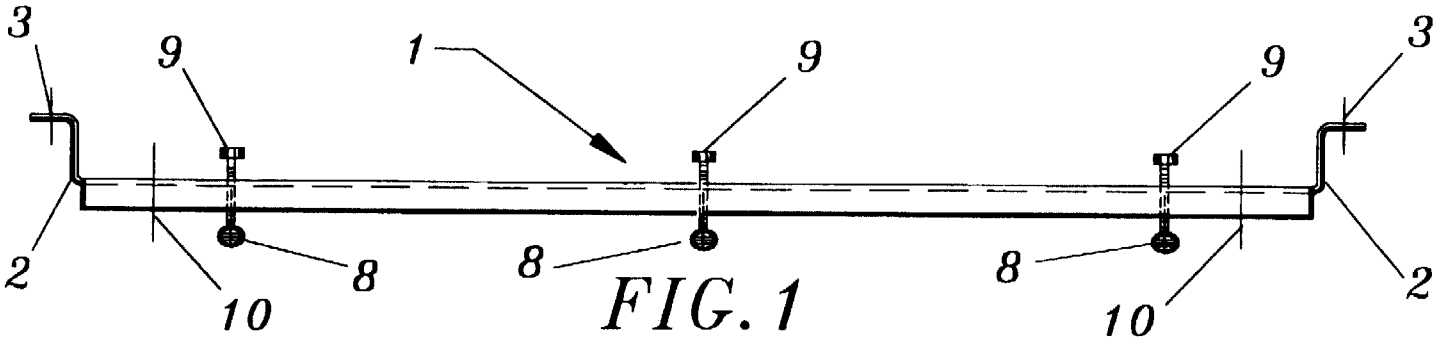
FIG. 1 illustrates a side view of the sink support.
Figure 2:
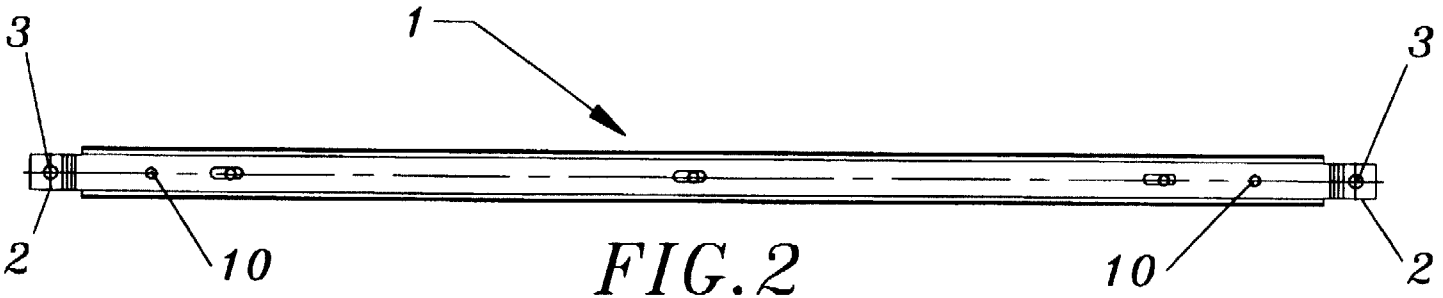
FIG. 2 illustrates a bottom view of the sink support.

The sink support consists of a cross member bracket with mounting brackets for vertical supports commonly under counter tops. When sinks are mounted in counter tops such as in kitchens or bathrooms, the counter top is normally supported by vertical material such as cabinets under the counter top or some other frame structure. This provides the vertical support for use of the sink support. In addition, the sink support can be provided with screws for leveling the sink relative to the counter top.

Referring to FIGS. 1 through 4, a cross member (1) has a mounting bracket (2) at each end. The mounting brackets (2) are generally right angle brackets such that they may rest on a vertical support (15) on one end and be attached to the cross member (1) at the other end as illustrate in FIG. 4. The cross-member (1) may be made of any suitable material having the strength to support a sink (4). Wood, metal, composites or other materials may be used.

In the preferred embodiment a metal cross member (1) has been demonstrated in a "U" shape to provide strength and rigid support for the weight of a sink (4). In this version the mounting bracket (2) at each end is formed as part of the metal of the cross member (1).

The mounting brackets (2) may have apertures (3) for purposes of attaching the sink support to the vertical support (15) by means of a screw or other fastener. With two sink supports mounted on the vertical supports (15) under the counter top (6), a sink (4) may be placed on the supports at its edges (5).

Most installations require an adjustment or leveling of the sink (4) for proper alignment with the counter top (6) in the cutout (7). In the preferred embodiment a sink adjusting means includes adjustment screws (8) with caps (9) provided in thread holes (10) in the cross member (1). This provides for a simple turning of each adjustment screw (8) to properly align the sink (4) vertically with the counter top (6).

Figure 5:
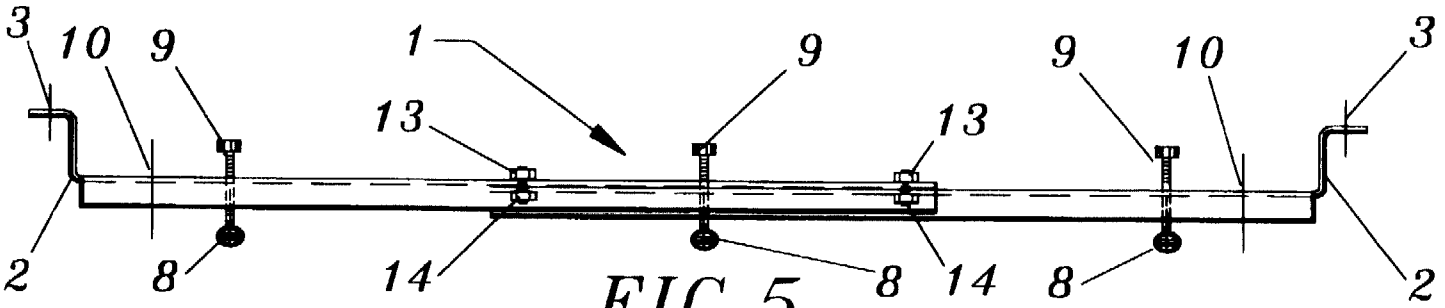
FIG. 5 illustrates a side view of an adjustable sink support.
Figure 4:
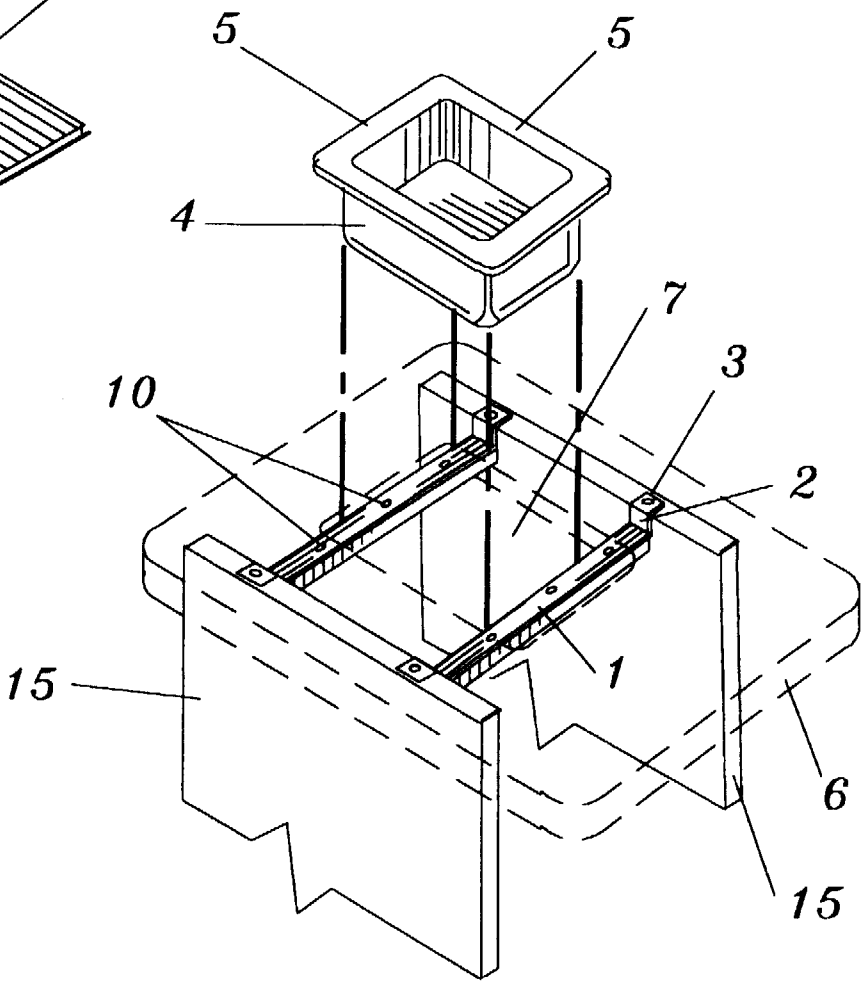
FIG. 4 illustrates a perspective view of the sink support on vertical supports.
Figure 3:
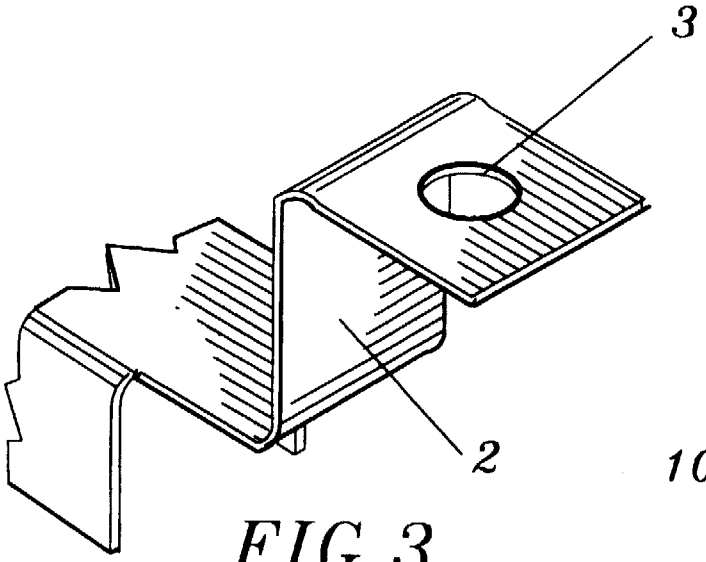
FIG. 3 illustrates an end view of the sink support.

Referring to FIG. 5, as an alternative to a fixed length cross member (1) for standard size cabinets and counter tops (6), a variable length cross member (1) may be used. As illustrated in FIG. 5 such a cross member (1) has overlapping ends (11, 12) which when fit to the particular cabinet are rigidly fastened by nuts (13) and bolts (14).

I claim:

1. A device for mounting a sink with a counter top comprising:

a cross member having a mounting bracket attached at each end and the cross member has a U-shape along its longitudinal axis;

the mounting bracket is a right angle bracket having an aperture defined therein; and the cross member having a sink adjusting means for adjusting the height of the sink supported thereon comprising a threaded hole disposed in the cross member with an adjustment screw threaded into the threaded hole wherein the adjustment screw is oriented to support the sink vertically when the mounting bracket is mounted to a plurality of sink vertical supports.

2. The device as in claim 1 wherein there is a cap on the end of the adjustment screw.

3. A device for mounting a sink with a counter top comprising:

a cross member formed of two overlapping ends wherein the two overlapping ends are rigidly connected by a nut and bolt attached through the two overlapping ends having holes defined therein;

a mounting bracket attached at each end of the cross member and the cross member has a U-shape along its longitudinal axis;

the mounting bracket is a right angle bracket having an aperture defined therein; and the cross member having a sink adjusting means for adjusting the height of the sink supported thereon comprising a threaded hole disposed in the cross member with an adjustment screw threaded into the threaded hole wherein the adjustment screw is oriented to support the sink vertically when the mounting bracket is mounted to a plurality of sink vertical supports.

4. The device as in claim 3 wherein the overlapping end and the mounting bracket are formed as one piece of metal.

* * * * *